United States Patent [19]

Berkes

[11] Patent Number: 4,698,290

[45] Date of Patent: Oct. 6, 1987

[54] PROCESS FOR ENERGY REDUCTION WITH FLASH FUSING

[75] Inventor: John S. Berkes, Webster, N.Y.

[73] Assignee: Xerox Corporation, Stamford, Conn.

[21] Appl. No.: 807,728

[22] Filed: Dec. 11, 1985

[51] Int. Cl.[4] ..... G03G 13/20; G03G 9/08

[52] U.S. Cl. ..... 430/124; 430/126; 430/110

[58] Field of Search ..... 430/124, 126

[56] References Cited

U.S. PATENT DOCUMENTS

| | | | |
|---|---|---|---|
| 3,829,314 | 8/1972 | Shelffo . | |
| 4,100,087 | 7/1978 | Takayama et al. . | |
| 4,145,300 | 3/1979 | Hendriks . | |
| 4,271,249 | 6/1981 | Gilliams et al. | 430/101 |
| 4,331,755 | 5/1982 | Gilliams et al. | 430/106 |
| 4,352,877 | 10/1982 | Narusawa et al. | 430/97 |
| 4,409,312 | 10/1983 | Ikeda et al. | 430/110 |
| 4,460,672 | 7/1984 | Gruber et al. | 430/110 |
| 4,535,049 | 8/1985 | Honda et al. | 430/137 |
| 4,556,624 | 12/1985 | Gruber et al. | 430/110 |

FOREIGN PATENT DOCUMENTS

| | | | |
|---|---|---|---|
| 56-5557 | 1/1981 | Japan | 430/124 |

*Primary Examiner*—Roland E. Martin

*Attorney, Agent, or Firm*—E. O. Palazzo

[57] ABSTRACT

Disclosed is a process for affecting a reduction in the energy needed for accomplishing the flash fusing of a developed image which comprises (1) providing a toner composition with resin particles, pigment particles, and wax; (2) introducing the aforementioned toner composition into a xerographic imaging apparatus having incorporated therein a flash fusing device; (3) generating an electrostatic latent image in said imaging apparatus, and subsequently developing this image with said toner composition; (4) transferring the image to a supporting substrate; and (5) permanently attaching the image to the substrate with energy emitted from a flash fusing device, and wherein there is formed between the supporting substrate and the toner composition during fusing a wax layer.

21 Claims, 4 Drawing Figures

PROCESS FOR ENERGY REDUCTION WITH FLASH FUSING

BACKGROUND OF THE INVENTION

This invention is generally directed to a process, and more specifically to a process for achieving a reduction in the energy requirements for affecting flash fusing in an electrostatographic imaging process. Therefore, in accordance with the present invention there is provided a process for permanently fixing developed images to a supporting substrate with less energy by, for example, forming a waxy interface between the toner composition and the substrate. In one embodiment of the present invention, developed images are permanently fixed to a paper substrate by flash fusing with an energy reduction of from about 5 to about 20 percent, and wherein there is situated between the toner composition and the paper substrate a waxy layer. The process of the present invention is particularly useful in electrostatographic imaging apparatuses having incorporated therein a flash fusing device such as a xenon lamp.

The formation and development of images on the surface of electrophotographic materials, referred to in the art as photoreceptors for example by electrostatic means, is well known, these processes involving subjecting the photoconductive material to a uniform charge; and subsequently exposing the surface thereof to a light image of the original to be reproduced. The latent image formed on the xerographic photoconductive surface is developed with toner particles specifically prepared for this purpose. Thereafter, the developed image can be transferred to a final support material such as paper, and affixed thereto to obtain a permanent record or copy of the original. Numerous method are known for applying the electrostatic toner particles to the electrostatic latent image, including for example, cascade development, magnetic brush development, powder cloud development and touchdown development.

The image formed can be fixed by a number of various well known techniques including, for example, vapor fixing, heat fixing, pressure fixing, or combinations thereof, as described for example in U.S. Pat. No. 3,539,161. These techniques of fixing, while suitable for certain purposes, suffer from some deficiencies thereby rendering their use either impractical or difficult for specific electrostatographic applications. For example, it is difficult to construct an entirely satisfactory heat fuser which has high efficiency, can be easily controlled, and has a desirable short warm-up time. Also, heat fusers sometimes burn or scorch the support material. Somewhat similar problems including, for example, image offsetting and undesirable resolution degradation, are present with pressure fusing methods. Additionally, with these processes consistently desirable permanent images are not obtained. Further, although vapor fixing has advantages, one of its main disadvantages is that a toxic solvent is used, therefore, in many situations this method becomes commercially unattractive because of health hazards associated therewith. Also, equipment and apparatus to sufficiently isolate the fuser in vapor processes from the surrounding area is very complex, costly and difficult to operate.

Many of the modern electrostatographic reproducing apparatuses, which are capable of producing copies at an extremely rapid rate, created the need for the development of new materials and processing techniques.

With these systems, radiant flash fusing is one of the preferred fixing processes selected in that the energy which is emitted in the form of electromagnetic waves is immediately available and requires no intervening medium for its propogation. Although an extremely rapid transfer of energy between the source and the receiving body is provided with the flash fusing process, a problem encountered with this process resides in obtaining an apparatus which can fully and efficiently utilize a preponderance of the radiant energy emitted by the source during a relatively short flash. The toner image in these systems usually comprises a relatively small percentage of the total area of the copy receiving the radiant energy causing most of the energy generated to be wasted as it is transmitted to the image, or is reflected away from the fusing areas. Furthermore, many of the toner compositions currently available, particularly colored toner compositions, contain pigments which do not absorb energy in the near infrared region of the spectrum thereby necessitating the supply of larger amounts of energy to these compositions to affect fusing. Moreover, many of the known colored toner compositions contain pigments therein which do not absorb energy in the near infrared and/or ultraviolet region of the spectrum, thus only about 33 percent of the spectral energy generated, for example, from presently used Xenon lamps is desirably absorbed by the colorants contained in the toner composition.

Specifically, for example, radiation energy emitted from a Xenon flash lamp, or similar source, is absorbed by the pigment or dye contained in the toner composition; and thereafter, this energy is converted to thermal energy by a radiationless decay process enabling heat generation causing the particles to fuse. The flash energy used is absorbed in a layer of toner of finite thickness adjoining the outer toner surface with absorption being greatest at the surface. This energy is also constantly decreasing with increasing distance from the outer toner surface. The flash generated is of very short duration, on the order of about one millisecond; and consequently, the toner regions very close to the surface are heated to a much higher temperature than the toner mass as a whole.

Examples of known flash fusion systems that may be selected for the present invention include those as described in U.S. Pat. Nos. 3,529,125; 3,903,394; and 3,474,223; the disclosure of each of these patents being totally incorporated herein by reference. Generally, the flash fuser selected contains a Xenon lamp, the output of the lamp being primarily in the visible and near infrared wavelengths of the regions. The output of the flash lamp is measured by Joules using the capacitor bank energy in accordance with the formula $\frac{1}{2}$ $CV^2$ wherein C is capacitance and V is the voltage. One of the main advantages of such a flash fuser over other known methods of fusing is, as indicated herein, that the energy propagated in the form of electromagnetic waves is immediately available, and no intervening source is needed. Also, such flash fusing systems do not require long warm-up periods, and the energy does not have to be transferred through a relatively low conductive or corrective heat transfer mechanism.

Moreover, toner and developer compositions with waxy materials are known. Thus, for example, there is described in British Patent No. 1,442,835 a toner composition comprised of a styrene homopolymer or copolymer resin, and at least one polyalkylene compound selected from polyethylene and polypropylene. According to the disclosure of this patent, reference page 2, beginning at line 90, the starting polymer resin may be either a homopolymer of styrene, or a copolymer of styrene with other unsaturated monomers, specific examples of which are disclosed on page 3, beginning at line 1. Polyalkylene compounds selected for incorporation into the toner compositions disclosed in this patent include those of a low molecular weight, such as polyethylene, and polypropylenes of an average molecular weight of from about 2,000 to about 6,000.

Additionally, there is illustrated in U.S. Pat. No. 4,460,672, the disclosure of which is totally incorporated herein by reference, a developer composition mixture comprised of electrostatic toner particles consisting of resin particles, pigment particles, a waxy material with a molecular weight of from about 500 to about 20,000, and further included in the composition from about 0.5 percent by weight to about 10 percent by weight of a charge enhancing additive selected from, for example, alkyl pyridinium halides, organic sulfonate compositions, and organic sulfate compositions.

Also, there is disclosed in U.S. Pat. No. 4,206,247, the disclosure of which is totally incorporated herein by reference, a developer composition comprised of a mixture of resins including a low molecular weight polyolefin and alkyl modified phenol resins. More specifically, it is indicated in this patent, reference column 4, line 6, that the invention is directed to a process which comprises the steps of developing an image with toner particles containing in certain proportions at least one resin selected from group A; and at least one resin selected from group B, wherein the resins of group A include a low molecular weight polyethylene, a low molecular weight polypropylene, and similar materials; and wherein the group B resins include natural resin modified maleic acid resins, and natural modified pentaerythritol resins. As examples of group A resins, there are mentioned polystyrene, styrene series copolymers, polyesters, epoxy resins, and the like, reference the disclosure in column 5, line 47. The molecular weight of the polypropylene, or polyethylene used is from about 1,000 to about 10,000, and preferably from about 1,000 to about 5,000.

There are also described in various copending applications toner compositions with wax components therein, reference for example U.S. Ser. No. 655,381 now U.S. Pat. No. 4,556,624, entitled Toner Compositions with Crosslinked Resins and Low Molecular Weight Wax Components, the disclosure of which is totally incorporated herein by reference. Specifically, the aforementioned copending application illustrates an improved positively charged electrostatic toner composition comprised of a polyblend mixture of a crosslinked copolymer composition; and a second polymer, pigment particles, a wax component of a molecular weight of from about 500 to about 20,000, and a charge enhancing additive. Other patents of interest include U.S. Pat. No. 3,079,342, relating to toners comprised of polystyrene and polymeric modifiers incorporated therein such as long chain thermoplastic plasticizers; U.S. Pat. No. 4,329,415, relating to magnetic developer compositions with waxes therein such as vegetable waxes, whale wax and synthetic waxes including polyethylene wax, and polypropylene wax; U.S. Pat. No. 4,362,803, describing one component magnetic developers with low molecular weight polyethylene and polypropylene; and U.S. Pat. No. 4,385,107, disclosing toner compositions comprised of specific graft copolymers inclusive of polyethylene and polyproplyene.

Nevertheless, there remains a need for processes wherein the energy emitted for the fixing of images is substantially reduced. Also, there is a need for electrostatic processes wherein the developed images are permanently fixed to a supporting substrate with a flash fusing device that emits 5 to 20 percent less energy as compared to prior art fixing processes. Furthermore, there is a need for processes for affecting the permanent fixing of images of high quality to paper substrates wherein the amount of energy needed for flash fusing is from about 4 to about 8 joules/inch$^2$. Moreover, there is a need for processes wherein a low molecular weight wax component is present as a coating on the exterior surfaces of the toner particles, and wherein less energy is required during the flash fusing process. Also, there is a need for processes that enable a reduction in the flash fusing energy requirements in a xerographic imaging system wherein there is situated between the developed image and the paper substrate a waxy layer.

SUMMARY OF THE INVENTION

It is an object of the present invention to provide processes for achieving a reduction in energy requirements during flash fusing.

In a further object of the present invention there are provided processes for permanently affixing images to paper substrates with flash fusing wherein a waxy component is present.

Another object of the present invention resides in a process for reducing the flash fusing energies from about 5 to about 20 percent by selecting toner particles and a waxy layer saturated between the particles and a supporting substrate.

Also, in a further object of the present invention, there are provided processes for affecting the permanent attachment of images to paper substrates by flash fusing with energies of from about 4 to about 8 joules/inch$^2$; and wherein a wax component layer is situated between the toner composition and the paper substrate.

Additionally, in a further object of the present invention there are provided imaging and printing processes wherein reduced energy output is needed during flash fusing as a result of the presence of a wax component layer.

These and other objects of the present invention are obtained by a process which comprises (1) providing a toner composition of resin particles, pigment particles, and a wax or other low viscosity material; (2) incorporating the resulting toner composition into an electrostatographic imaging apparatus with a flash fusing device therein; (3) forming an electrostatic latent image therein and subsequently developing this image with said toner composition; (4) transferring the developed image to a supporting substrate; and (5) permanently affixing the image thereto with a flash fusing device generating an energy of from about 4 to about 8 joules/inch$^2$, and preferably of from about 5 to 7 joules/inch$^2$; and wherein there is present between the toner particles and the substrate during fusing a wax or low viscosity interface layer. In another specific embodiment of the present invention, there is provided a process which comprises (1) providing a toner composition with resin particles, pigment particles, and a wax; (2) adding the toner composition to an electrostatographic imaging apparatus with a flash fusing device incorporated therein; (3) generating an electrostatic latent image and subsequently affecting development thereof with said toner composition; (4) transferring the developed image to a supporting substrate, wherein there is provided by heating the toner composition, and situated between the supporting substrate and the toner composition a wax layer thereby enabling a reduction in the amount of energy emitted by the flash fusing device.

BRIEF DESCRIPTION OF THE DRAWINGS

For a better understanding of the present invention and further features thereof reference is made to FIGS. 1 to 4, which figures represent line graphs detailing the fused image densities and the unfused image densities for toner compositions with and without wax.

With further regard to the process of the present invention, examples of toner resins that can be selected for incorporation therein include polyesters, such as those described in U.S. Pat. Nos. 3,655,374 and 3,590,000, the disclosures of which are totally incorporated herein by reference; diolefins such as styrene/-butadiene resins, styrene/methacrylate resins, epoxies, vinyl resins and polymeric esterification products of a dicarboxylic acid and a diol comprising a diphenol; and mixtures thereof. Suitable vinyl resins may include homopolymers or copolymers of two or more vinyl monomers. Examples of vinyl monomers selected are styrene, p-chlorostyrene, ethylenically unsaturated mono-olefins such as ethylene, propylene, butylene, isobutylene and other similar olefins; vinyl esters such as vinyl acetate, vinyl butyrate and the like; esters of alphamethylene aliphatic monocarboxylic acids such as methyl acrylate, ethyl acrylate, nbutylacrylate, isobutyl acrylate, methyl methacrylate, ethyl methacrylate, butyl methacrylate and the like; diolefins including styrene butadiene copolymers, and the like.

Figure 1:
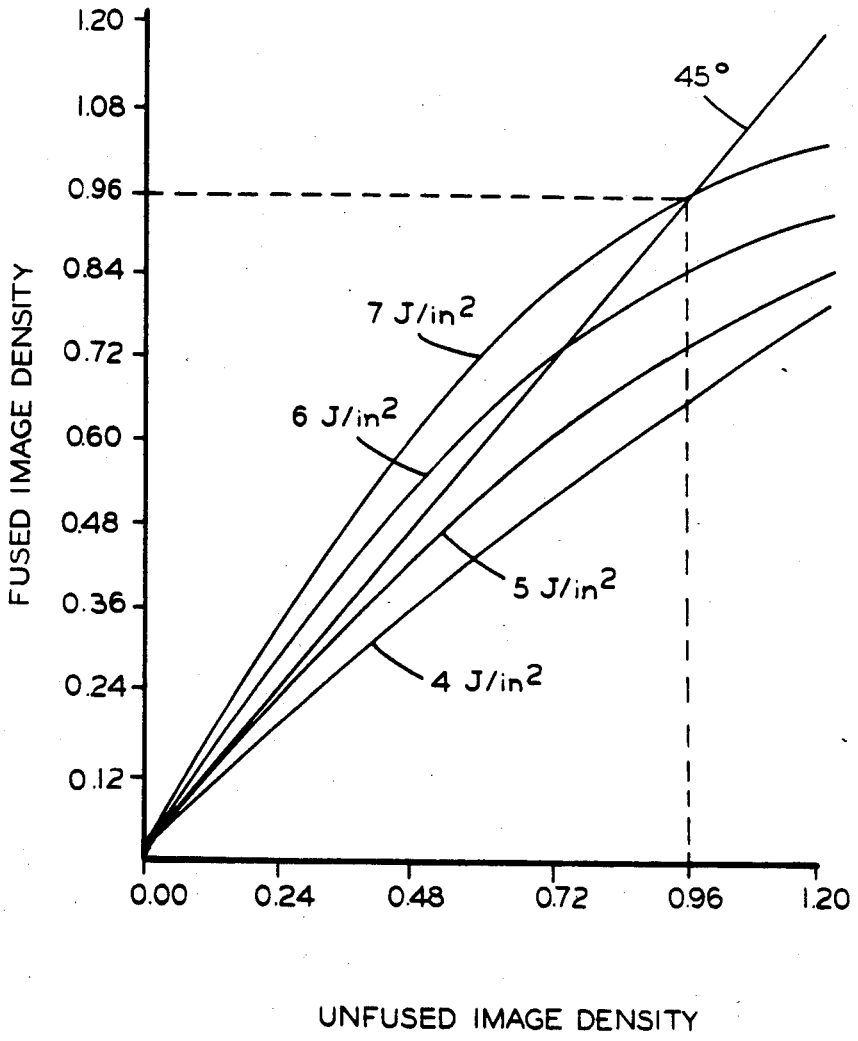

The preferred toner resins are selected from polystyrene methacrylates; polyesters such as those described in U.S. Pat. No. 3,655,374, the disclosure of which is totally incorporated herein by reference; polyester resins resulting from the condensation of dimethylterephthalate, 1, 3 butanediol, and pentaerythritol; and Pliolite resins. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene.

Various suitable colorants and/or pigment particles may be incorporated into the toner and developer composition of the present invention including, for example, carbon black, Nigrosine dye, magnetic particles, such as Mapico Black, a mixture of iron oxides, and the like. The pigment particles are present in the toner in sufficient quantities so as to render it highly colored enabling the formation of a visible image on a recording member. Thus, for example, the pigment particles, with the exception of magnetic materials, should be present in the toner composition in an amount of from about 2 percent by weight to about 15 percent by weight, and preferably from about 2 percent by weight to about 10 percent by weight. With regard to magnetic pigments such as Mapico Black, they are generally incorporated into the toner composition in an amount of from about 10 percent by weight to about 70 percent by weight, and preferably in an amount of from about 20 percent by weight to about 50 percent by weight.

While the magnetic particles can be present in the toner composition as the only pigment, these particles may be combined with other pigments such as carbon black. Thus, for example, in this embodiment of the present invention, the other pigments are present in an amount of from about 10 percent by weight to about 15 percent by weight, mixed with from about 10 to about 60 percent by weight of magnetic pigment. Other percentage combinations may be selected provided the objectives of the present invention are achieved.

Illustrative suitable different waxes that can be selected for the process of the present invention include, for example, synthetic waxes, low density polyethylenes, paraffin waxes; waxes of a molecular weight of from about 500 to about 20,000 such as polyethylenes available from Allied Chemical and Petrolite Corporation; Epolene N-15, commercially available from Eastman Chemical Products Company; Viscol 550-P, a low molecular weight polypropylene available from Sanyo Kasei K.K.; and similar materials. The commercially available polyethylenes selected have a molecular weight of about 1,000 to 1,500 while the commercially available polypropylenes incorporated into the toner compositions of the present invention have a molecular weight of from about 4,000 to about 6,000. Many of the polyethylene and polypropylene compositions useful in the present invention are illustrated in British Patent No. 1,442,835, the disclosure of which is totally incorporated herein by reference.

Various effective amounts of wax can be selected providing the objectives of the present invention are achievable, including for example from between 1 to about 20 percent by weight of wax. Although it is not desired to be limited by theory, an amount of wax is selected that will enable a fine dispersion of the wax particles in the toner composition; and provide subsequent to heating during fixing, or prior to fusing, at a temperature of from about 300° to about 350° C., a wax layer as indicated herein.

During fusing it is believed that the aforementioned wax will flow and provide a low viscosity interface between the developed image with toner thereon and the substrate such as paper. Alternatively, the toner containing the wax can be heat spheroidized thereby enabling the wax to coat the toner particles with a thin layer, about 0.1 micron. With further respect to the wax, one of the primary considerations in its selection is that it possess melt characteristics, that is, a melting temperature lower than the toner resin selected. Consequently, the wax has a lower viscosity than the toner polymer at all temperatures during the fusing process. It is believed that the aforementioned wax characteristics permit flowability thereof and allow the formation of a liquid interface between the higher viscosity toner polymer and the substrate. Further, the presence of this interface permits the wetting and spreading of toner at lower energies, as illustrated herein, in contrast to when the interface is not present. It is in this manner that there results a reduction in the flash fusing energy.

The toner compositions of the present invention are admixed with carrier components in formulating the developer composition selected for incorporation into an electrostatographic imaging apparatus. As carrier particles, there can be selected well known components including steel, iron ferrites, sponge iron, and the like. Generally, the carrier particles include a coating thereover such as terpolymers of a polymerized styrene, polymerized acrylate or methacrylate, and a polymerizable organo silicon composition, reference U.S. Pat. Nos. 3,526,533 and 3,467,634, the disclosures of which are totally incorporated herein by reference. Other coatings that can be selected include known fluoropolymers such as polyvinylidene fluoride, commercially available from the E.I. DuPont Company. Generally, the carrier component is mixed with the toner composition in effective suitable combinations; however, best results are obtained with from about 1 part by weight of toner particles to about 100 to about 1,000 parts by weight of carrier particles. Preferred are developer compositions wherein the toner concentration ranges from about 1 percent to about 10 percent.

Additive components that may be blended with the toner resin particles include colloidal silicas, reference U.S. Pat. Nos. 3,720,617 and 3,900,588, the disclosures of which are totally incorporated herein by reference. Generally, the colloidal silica, which functions primarily as a powder flow additive, is present in an amount of from about 0.1 percent to about 1 percent. Furthermore, there can be selected as additives metal salts and metal salts of fatty acids, inclusive of zinc stearate, reference U.S. Pat. Nos. 3,590,000 and 3,983,045, the disclosures of which are totally incorporated herein by reference. The aforementioned additives are generally present in an amount of from about 0.1 percent by weight to about 10 percent by weight.

Photoconductive members that can be selected for generating the electrostatic latent image include amorphous selenium; selenium alloys, such as selenium arsenic, selenium antimony, selenium tellurium, selenium tellurium arsenic; halogen doped selenium substances; and halogen doped selenium alloys, wherein for example the dopant is preferably present in an amount of from about 20 parts per million to about 100 parts per million. Dopants that are selected are well known and include chlorine and bromine.

Figure 2:
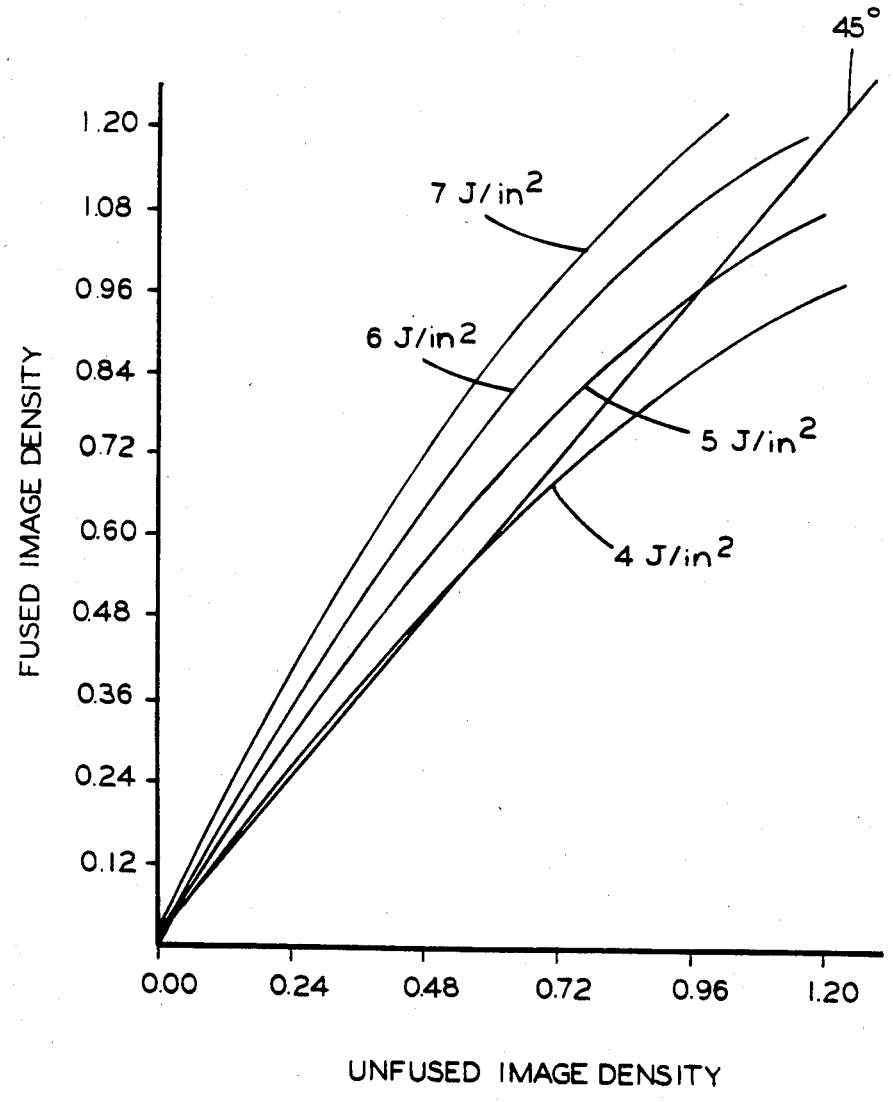

With further respect to the process of the present invention, the data represented in the line graphs illustrated in FIGS. 1 to 4 further demonstrate the results achievable with the process of the present invention. In these Figures, there is plotted the fused image density versus the unfused image density for various toner compositions. Specifically, FIGS. 1 and 2 illustrate line graphs demonstrating the flash fusing data for toners with and without wax. The line graphs in FIGS. 1 and 2 represent the relationships of the unfused image density, as generated with Xerox 4024 DP paper, to the fused image density. Each of these Figures contain data for flash fusing energies of 4, 5, 6 and 7 joules/inch$^2$. More specifically, a comparison between line graphs of FIGS. 1 and 2 indicate that the toner composition with wax, that is FIG. 2, requires 2 joules/inch$^2$ less flash energy as compared to the toner without wax, reference FIG. 1. Also, no fixing penalty was observed for the toner of FIG. 2 as compared to that of FIG. 1 which had no wax therein since the polyester toner resin selected flows readily into the paper thereby interlocking itself with the paper fibers. There was selected for FIG. 1 90 percent by weight of a polyester resin prepared from the reaction of bis-phenol A, propylene oxide, and fumaric acid; and 10 percent by weight of carbon black particles. Further, there was added to this composition 0.5 percent of powder Aerosil. The toner composition of FIG. 2 was comprised of 70 percent by weight of the polyester resin selected for FIG. 1, 10 percent by weight of carbon black, and 20 percent by weight of polypropylene wax of a molecular weight of less than 6,000. Additionally, this toner composition includes therein, as an external additive, 0.5 percent by weight of powder Aerosil. Also, the average diameter of the toner particles for the FIGS. 1 and 2 compositions was about 12 to 13 microns. Further, the image densities were measured on a MacBeth densitometer by subjecting the toner image in each instance to light, and measuring the density prior to fusing (unfused density), and subsequent to fusing (fused density). Thus, with the compositions of FIG. 2, wherein a wax layer is formed between the toner and the paper, for the same energy level higher fused densities are achieved; or for the same image densities lower fusing energies are required.

Figure 3:
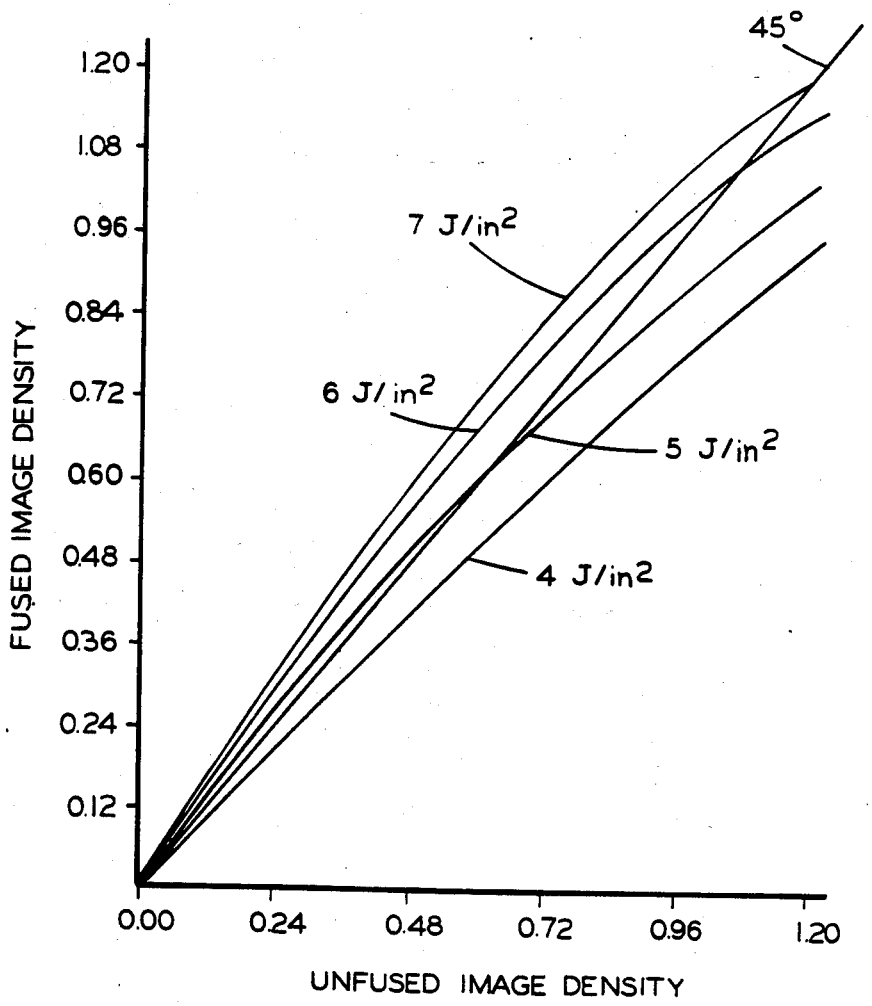
Figure 4:
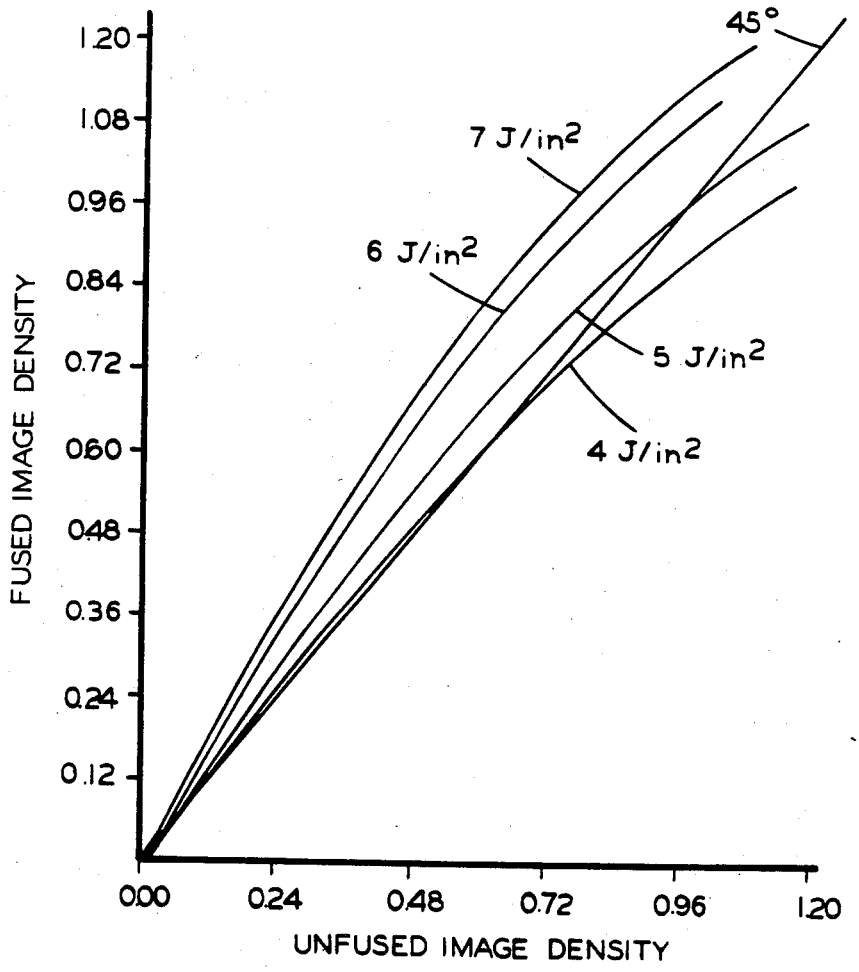

Similarly, there are illustrated in FIGS. 3 and 4 line graphs plotting the fused image density versus the unfused image density with toner compositions containing no wax, reference FIG. 3; and those with wax, reference FIG. 4. The FIG. 3 toner composition contained 90 percent by weight of a Pliolite resin consisting of styrene butadiene, 89 percent of styrene and 11 percent by weight of butadiene; and 10 percent by weight of carbon black particles. Also, there was added 0.5 percent by weight of Aerosil to the toner composition. The FIG. 4 toner composition contains 70 percent by weight of the Pliolite resin, 10 percent by weight of carbon black, and 20 percent by weight of a polypropylene wax of a molecular weight of less than about 6,000. Also, there was added to this toner composition 0.5 percent by weight of Aerosil. Also, in each instance the average diameter of the toner particles was from about 12 to 13 microns. A review of the data clearly evidences, for example, that with the presence of wax, formed as an interface between the toner and the paper as a result of heating during fusing at 350° C., there is a reduction in the flash fusing energy of about 1 joule/inch$^2$.

The following examples are being supplied to further define specific embodiments of the present invention, it being noted that these examples are intended to illustrate and not limit the scope of the present invention. Parts and percentages are by weight unless otherwise indicated.

EXAMPLE 1

There was prepared a toner composition by melt blending in a Banbury mixing device maintained at 120° C., followed by mechanical attrition, a toner composition containing 70 percent by weight of a polyester resulting from the condensation reaction of dimethylterephthalate, 1,3-butenediol, and pentaerythritol, 10 percent by weight of carbon black particles, and 20 percent by weight of a polypropylene wax with a molecular weight of about 5,000. Also, there was added to this composition 0.5 percent by weight of Aerosil R972. A developer composition was then prepared by mixing 2 parts by weight of this toner composition with 100 parts by weight of carrier particles consisting of a steel core coated with 1.25 percent by weight of a terpolymer of methylmethacrylate, styrene and a vinyl triethoxy silane.

This developer composition was then added to a xerographic imaging test fixture with a selenium photoreceptor and a Xenon flash fusing lamp. Subsequent to the formation of an electrostatic latent image, and development of this image with the above prepared toner compositions, the developed image was transferred to a paper substrate. There was then applied to the developed image on the paper substrate 2 joules/inch$^2$ less energy emitted from the Xenon lamp to permanently affix the image thereto, that is, 5 joules/inch$^2$ when the wax interface layer was present as compared to 7 joules/inch$^2$ when the interface was not present. During the aforementioned fusing, a wax layer of polypropylene was formed between the image and the substrate.

EXAMPLE II

The procedure of Example I was repeated with the exception that there was selected as the toner resin particles a styrene butadiene copolymer with 89 percent by weight of styrene and 11 percent by weight of butadiene. Substantially similar results were obtained except that the energy reduction was from 7 to 6 joules/inch$^2$.

Other modifications of the present invention will occur to those skilled in the art based upon a reading of the present disclosure. These are intended to be included within the scope of this invention.

What is claimed is:

1. A process for affecting a reduction in the energy needed for accomplishing the flash fusing of a developed image which comprises (1) providing a toner composition with resin particles, pigment articles, and wax, said wax possessing a lower melting temperature than the resin particles and selected from the group consisting of polyethylene and polypropylene with a molecular weight of less than about 6,000; (2) introducing the aforementioned toner composition into a xerographic imaging apparatus having incorporated therein a flash fusing device; (3) generating an electrostatic latent image in said imaging apparatus, and subsequently developing this image with said toner composition; (4) transferring the image to a supporting substrate; and (5) permanently attaching the image to the substrate with energy emitted from a flash fusing device, and wherein there is formed between the supporting substrate and the toner composition during fusing a wax layer.

2. A process in accordance with claim 1 wherein the energy required for fixing is from about 4 to about 7 joules/inch$^2$.

3. A process in accordance with claim 1 wherein the flash fusing device is a Xenon lamp.

4. A process in accordance with claim 1 wherein the wax is selected from a group consisting of paraffin waxes, bees wax, plasticizers, and polyalkylene components.

5. A process in accordance with claim 1 wherein the toner resin particles are selected from the group consisting of styrene methacrylate, styrene acrylates, polyesters and styrene butadienes.

6. A process in accordance with claim 1 wherein the pigment particles are carbon black.

7. A process in accordance with claim 1 wherein the wax layer is of a thickness of from about 0.01 micron to about 0.5 micron.

8. A process in accordance with claim 1 further including therein carrier particles.

9. A process in accordance with claim 8 wherein the carrier particles contain a coating thereover.

10. A process in accordance with claim 1 wherein the toner composition further includes therein additive particles selected from the group consisting of colloidal silicas, metal salts of fatty acids, and metal salts.

11. A process in accordance with claim 10 wherein the metal salt is zinc stearate.

12. A process in accordance with claim 10 wherein the colloidal silica is Aerosil.

13. A process for affecting a reduction in the energy needed for accomplishing the flash fusing of a developed image which comprises (1) providing a toner composition with resin particles, pigment particles, and was, said was possessing a lower melting temperature than the resin particles and selected from the group consisting of polyethylene and polypropylene with a molecular weight of less than about 6,000; (2) introducing the aforementioned toner composition into a xerographic imaging apparatus having incorporated therein a flash fusing device; (3) generating an electrostatic latent image in said imaging apparatus, and subsequently developing this image with said toner composition; (4) transferring the image to a supporting substrate; and (5) permanently attaching the image to the substrate with energy emitted from a flash fusing device, wherein the toner composition is heated subsequent to transferring the developed image to a supporting substrate thereby enabling the formation of a wax layer between the supporting substrate and the toner composition.

14. A process in accordance with claim 13 wherein there is further included in the toner composition additive particles selected from the group consisting of colloidal silica, metal salts, and metal salts of fatty acids.

15. A process in accordance with claim 1 wherein the toner composition is comprised of about 90 percent by weight of a polyester resin, about 10 percent by weight of carbon black particles, and about 0.5 percent by weight of colloidal silica additive particles.

16. A process in accordance with claim 13 wherein the toner composition is comprised of about 90 percent by weight of a styrene butadiene copolymer, 10 percent by weight of carbon black particles, and about 0.5 percent by weight of colloidal silica additive particles.

17. A process for affecting a reduction in the energy needed for accomplishing the flash fusing of a developed image which comprises (1) providing a toner composition with resin particles, pigment particles, and wax, said wax possessing a lower melting temperature than the resin particles and selected from the group consisting of polyethylene and polypropylene with a molecular weight of less than about 6,000; (2) introducing the aforementioned toner composition into a xerographic imaging apparatus having incorporated therein a flash fusing device; (3) generating an electrostatic latent image in said imaging apparatus, and subsequently developing this image with said toner composition; (4) transferring the image to a supporting substrate; and (5) permanently attaching the image to the substrate with energy emitted from a flash fusing device, and wherein the toner composition is heated subsequent to transferring the image to a supporting substrate and there is formed between the supporting substrate and the toner composition during fusing a wax layer.

18. A process in accordance with claim 17 wherein the energy required for fixing is from about 4 to about 7 joules/inch$^2$.

19. A process in accordance with claim 17 wherein the resin particles are selected from the group consisting of styrene methacrylate, styrene acrylates, polyesters, and styrene butadienes.

20. A process in accordance with claim 17 wherein the toner composition further includes therein additive particles selected from the group consisting of colloidal silicas, metal salts of fatty acids, and metal salts.

21. A process for affecting a reduction in the energy needed for accomplishing the flash fusing of a developed image which consists essentially of (1) providing a toner composition with resin particles, pigment particles, and wax, said wax possessing a lower melting temperature than the resin particles and selected from the group consisting of polyethylene and polypropylene with a molecular weight of less than about 6,000; (2) introducing the aforementioned toner composition into a xerograhic imaging apparatus having incorporated therein a flash fusing device; (3) generating an electrostatic latent image in said imaging apparatus, and subsequently developing this image with said toner composition; (4) transferring the image to a supporting substrate; and (5) permanently attaching the image to the substrate with energy emitted from a flash fusing device, and wherein the toner composition is heated subsequent to transferring the image to a supporting substrate and there is formed between the supporting substrate and the toner composition during fusing a wax layer, which toner composition further includes therein additive particles, and wherein the energy required for fixing is from about 4 to about 7 joules/inch$^2$.

* * * * *